US008887963B2

(12) United States Patent
Zizoune et al.

(10) Patent No.: US 8,887,963 B2
(45) Date of Patent: Nov. 18, 2014

(54) UNIVERSAL YOKE AND DISPENSING DEVICE FOR CANISTERS

(71) Applicants: Aziz Zizoune, New York, NY (US); Breana Therese Murphy, Brooklyn, NY (US)

(72) Inventors: Aziz Zizoune, New York, NY (US); Breana Therese Murphy, Brooklyn, NY (US)

( * ) Notice: Subject to any disclaimer, the term of this patent is extended or adjusted under 35 U.S.C. 154(b) by 91 days.

(21) Appl. No.: 13/873,676

(22) Filed: Apr. 30, 2013

(65) Prior Publication Data

US 2013/0292418 A1 Nov. 7, 2013

Related U.S. Application Data

(60) Provisional application No. 61/642,052, filed on May 3, 2012.

(51) Int. Cl.
*B67D 7/06* (2010.01)
*B05B 15/06* (2006.01)

(52) U.S. Cl.
CPC ..... *B05B 15/06* (2013.01)
USPC ..... 222/182; 222/162; 222/325; 222/402.1; 222/402.13; 222/402.15

(58) Field of Classification Search
USPC ..... 222/162, 182–183, 174, 402.1, 402.13, 222/402.15, 323–325
See application file for complete search history.

(56) References Cited

U.S. PATENT DOCUMENTS 3,516,424 A 6/1970 Eagle
3,920,162 A 11/1975 Kimura
3,987,942 A 10/1976 Morane et al.
4,089,440 A * 5/1978 Lee ..... 222/174
4,789,084 A * 12/1988 Yoshitomi ..... 222/174
4,886,191 A 12/1989 Yoshitomi
6,318,600 B1 11/2001 Winnett et al.
6,868,989 B2 3/2005 Fahy et al.
6,966,461 B2 * 11/2005 Warner et al. ..... 222/174
7,182,223 B2 2/2007 Healy et al.
7,252,210 B1 * 8/2007 Schultz et al. ..... 222/174
7,296,713 B2 * 11/2007 Mineau et al. ..... 222/182
7,308,992 B1 * 12/2007 Mineau et al. ..... 222/182
7,308,993 B2 12/2007 Mineau
7,637,393 B2 * 12/2009 Mineau et al. ..... 222/162
7,819,288 B2 * 10/2010 Healy et al. ..... 222/162
2006/0076366 A1 * 4/2006 Furner et al. ..... 222/402.13
2010/0084434 A1 4/2010 Rhoades

FOREIGN PATENT DOCUMENTS

DE 3841172 6/1990

* cited by examiner

*Primary Examiner* — Frederick C Nicolas

(74) *Attorney, Agent, or Firm* — Law Office of Peter G. Korytnyk, PLLC

(57) ABSTRACT

A universal yoke for actuating an actuation head of a canister is provided. The universal yoke can include a plurality of support ribs, an actuating nub including a first triggering surface, and an actuating tab including a second triggering surface. The plurality of support ribs can be arranged to nest with a plurality of differently shaped top portions of canisters. Either one of the first triggering surface and the second triggering surface can be arranged to independently actuate an actuation head of a nested canister top portion when the canister is forced into contact with the universal yoke. The universal yoke can be implemented with a dispensing device capable of cradling various-sized canisters.

20 Claims, 7 Drawing Sheets

UNIVERSAL YOKE AND DISPENSING DEVICE FOR CANISTERS

CROSS REFERENCE TO RELATED APPLICATION

The present application claims the benefit from an earlier filed U.S. Provisional Patent Application No. 61/642,052, filed May 3, 2012, which is incorporated herein in its entirety by reference.

FIELD OF THE INVENTION

The present teachings relate to a device for holding a canister and for dispensing product from the canister. In particular, the present teachings relate to a device that can support various-sized canisters and that allows ready application of dispensed product to hard-to-reach areas of the body.

BACKGROUND OF THE INVENTION

A wide variety of body products are applied to the body, including sunscreens, self-tanners, insect repellents, moisturizers, over-the-counter and prescription medicines, and the like. These body products come in many different forms including sprays, gels and lotions. In the current market there are a variety of devices for applying and dispensing body products including, for example, the following: (i) a traditional lotion dispenser where a user must first squirt product onto their hand and then apply it directly to a body part; (ii) a single spray bottle where a user pushes down on a trigger device to activate a pump that sprays product onto a body part; and (iii) an aerosol can where a user holds down an actuation head to open a valve that sprays the product onto a body part.

These body products can be applied to the body directly by hand or by using a traditional spray mechanism. Traditional spray mechanisms are activated by the fingers and hand of a user at a location that is very near to where the spray is released. As such, users have a difficult time applying product to hard-to-reach areas of the body, such as the middle of the back. This oftentimes results in users foregoing the application of product to these hard-to-reach areas, applying the body product sporadically or not uniformly, or simply having difficulty or discomfort in applying product.

Furthermore, for persons having physical disabilities and limited mobility, it can be nearly impossible to uniformly apply a body product to the middle back area, shoulders, feet, and other hard-to-reach areas.

Moreover, body products are sold in bottles and canisters having various different shapes and dimensions, as well as different actuation heads or caps. Known actuation heads for sunscreen canisters have different designs each requiring a different actuation or triggering point to result in product being dispensed. In particular, actuation heads for known sunscreen canisters can trigger either from areas near the center of the cap or from areas near the back of the cap. A slight shift in actuation force applied to these caps will result in the cap not triggering the dispensing of sunscreen product from the canister.

Accordingly, there is a need for an easy-to-use dispensing device that can be used with most currently available sunscreen canisters. A need also extends to a dispensing device that can allow a user to apply product easily and uniformly to hard-to-reach areas of the body.

SUMMARY OF THE INVENTION

The present teachings provide a universal yoke for actuating an actuation head of a canister. The universal yoke can include a plurality of support ribs, an actuating nub including a first triggering surface, and an actuating tab including a second triggering surface. The plurality of support ribs can be arranged to nest with a plurality of differently shaped top portions of canisters. Either one of the first triggering surface and the second triggering surface can be arranged to independently actuate the actuation head of a nested canister top portion when the canister is forced into contact with the universal yoke.

The present teachings further provide a universal dispensing device. The universal dispensing device can include a lower receptacle including a movable piston and an upper receptacle including a universal yoke. The universal yoke can include an actuating nub including a first triggering surface and an actuating tab including a second triggering surface. Either one of the first triggering surface and the second triggering surface can be arranged to independently actuate an actuation head of a canister cradled between the universal yoke and the piston when the actuation head is forced into contact with the universal yoke The present teachings still further provide a universal dispensing device. The universal dispensing device can include a housing receptacle configured to support a canister having an actuation head. A movable member can be arranged on one end of the housing receptacle and a universal yoke can be arranged on the other end of the housing receptacle. The universal yoke can include an actuating nub including a first triggering surface and an actuating tab including a second triggering surface. The first triggering surface and the second triggering surface can be arranged to independently actuate a plurality of differently shaped actuation heads of canisters.

Additional features and advantages of various embodiments will be set forth, in part, in the description that follows, and will, in part, be apparent from the description, or may be learned by the practice of various embodiments. The objectives and other advantages of various embodiments will be realized and attained by means of the elements and combinations particularly pointed out in the description herein.

Figure 1:
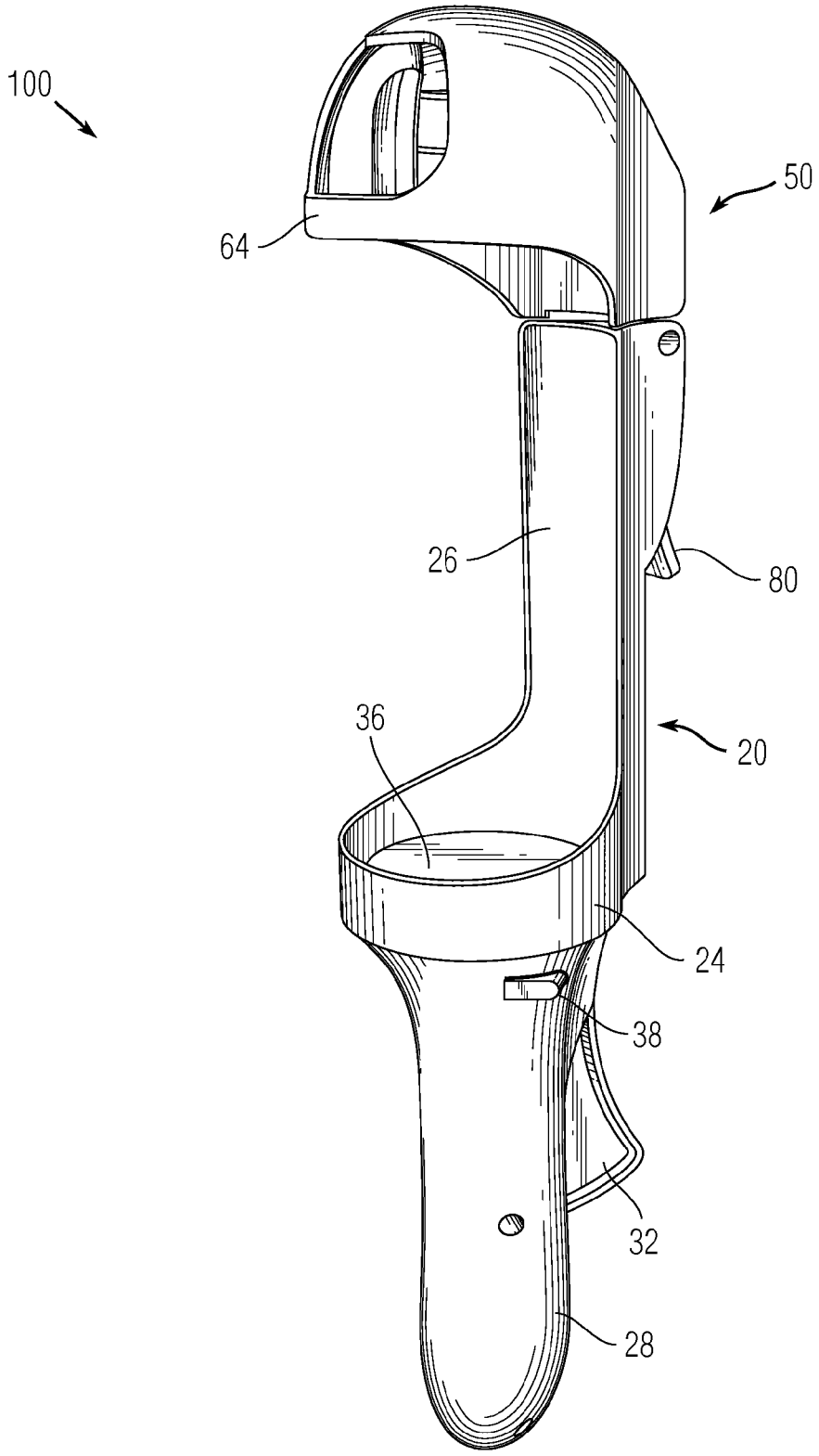
FIG. 1 shows a perspective view of an embodiment of a dispensing device of the present teachings.

It is to be understood that both the foregoing general description and the following detailed description are exemplary and explanatory only, and are intended to provide an explanation of various embodiments of the present teachings.

DETAILED DESCRIPTION OF THE INVENTION

The present teachings relate to a universal yoke and a dispensing device that can be used with various-sized canisters and various-shaped actuation heads that trigger the release of product from a canister. The yoke and dispensing device can be used to cradle various-sized aerosol canisters containing sunscreen. However, while the present teachings disclose the dispensing device cradling a canister containing sunscreen, the dispensing device could be used with bottles, cans, canisters, and the like, containing various other aerosol and non-aerosol products, such as, for example, self-tanners, oils, anti-itch sprays, spray paint, lubricant, window cleaner.

Actuation heads for sunscreen canisters generally fall into 5 different designs, each requiring a different trigger point to result in product being dispensed. FIGS. 6A to 6E show the shapes of the five most common actuation heads 90 of sunscreen canisters 96 along with a universal yoke 64 of the present teachings nested with the top portion of the canisters 96 to allow independent actuation of each the different trigger points. As will be discussed in more detail below, the universal yoke 64 of the present teachings provides two different triggering surfaces 74, 78 in addition to an inner geometry capable of nesting with the top portions (including the actuation head designs) of the most commonly used sunscreen canisters. Moreover, the dispensing device 100 of the present teachings is adjustable to fit the heights and widths of the most commonly used sunscreen canisters.

Figure 2:
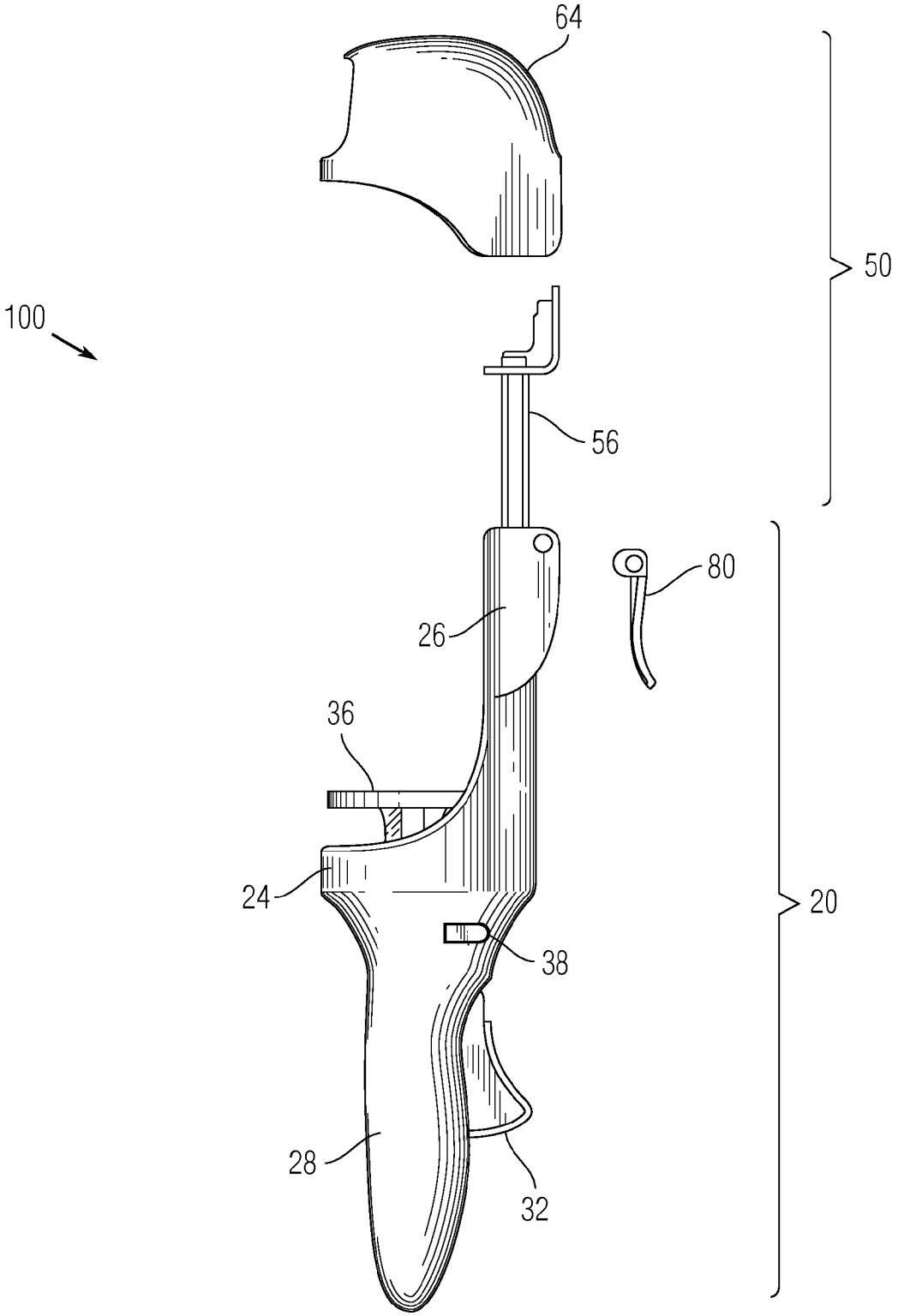
FIG. 2 shows a partially exploded perspective view of the dispensing device of FIG. 1.

Referring to FIGS. 1 and 2, a preferred embodiment of a dispensing device 100 of the present teachings can include a lower receptacle 20 and an upper receptacle 50. The upper receptacle 50 can be arranged to be moved with respect to the lower receptacle 20 to allow adjustment for different sized and shaped canisters used with the dispensing device 100. A latch 80 can be provided to lock the position of the upper receptacle 50 with respect to the lower receptacle 20 once a canister has been inserted into the dispensing device 100.

The lower receptacle 20 can include a base 24, a handle 28, a trigger 32, and a movable piston 36 actuable by a trigger 32. The movable piston 36 can form a floor of the base 24 and can reciprocate with respect to the base 24. The base 24 can be shaped to accept a bottom portion of a canister which can rest on the movable piston 36. The base 24 can include an upwardly extending body portion 26. The base 24 can include a generally open structure that generally does not cover a canister body that has been loaded into the dispensing device 100. The latch 80 can be arranged on the upwardly extending body portion 26.

The handle 28 of the lower receptacle 20 can be sized and shaped to be held comfortably in the hand of a user and is operable to allow remote actuation of product from the loaded sunscreen canister 96. A portion of the handle 28 can include gripping features to promote secure use of the dispensing device 100. The gripping area can be specifically contoured to a conventional users' hand for comfort and control during use of the dispensing device 100. The handle 28 can be aesthetically designed. The handle 28 and trigger 32 can be designed to allow users of differing physical abilities to use the dispensing device 100 in a comfortable manner for short or long periods of time. The handle 28 can include a visual marking near the latch 80 to indicate which direction locks the dispensing device 100.

A spring and lever mechanism can be provided between the trigger 32 and the piston 36 for actuating movement of the piston 36. When the trigger 32 is depressed, the mechanism can allow the piston 36 to move upwardly against the force of a spring. Upon release of the trigger 32, the spring can force the piston 36 back into a pre-activation position. The trigger 32 is maintained in the pre-activation position when not in use. The trigger 32 can be designed to contour with a users' index and middle fingers so that activation of the dispensing device 100 can be done comfortably with minimal effort. While a spring and lever mechanism is disclosed in the present teachings, any actuation mechanism can be implemented to actuate the piston 36 as would be appreciated by one of ordinary skill in the art. A safety mechanism 38 can be provided to allow the trigger 32 to be locked to prevent accidental actuation of the piston 36.

As best shown in FIG. 2, the upper receptacle 50 can include a neck 56 and the universal yoke 64. The universal yoke 64 and the neck 56 can be secured to one another or can be formed as an integral, one-piece structure.

As will be described in more detail below, the universal yoke 64 of the upper receptacle 50 allows various shapes of known sunscreen canisters to be cradled between the upper receptacle 50 and the lower receptacle 20. The universal yoke 64 includes an outer dome-shaped housing 62 which supports an inner rim geometry. The specific inner rib geometry of the universal yoke 64 allows the various shapes of actuation heads 90 as found on the most commonly used sunscreen canisters to nest and be actuated. The universal yoke 64 can also include a main window opening 66 to allow unimpeded flow of an atomized spray from the dispensing device 100.

Relative movement between the base 24 of the lower receptacle 20 and the neck 56 of the upper receptacle 50 allow the universal yoke 64 to be raised and lowered in an axial direction along a longitudinal axis of the dispensing device 100. In a preferred embodiment, the neck 56 can be arranged to slide within a guide track formed on the upwardly extending body portion 26 of the base 24. The neck 56 can include a series of teeth that can engage with the latch 80 to allow the position of the upper receptacle 50 to be locked with respect to the lower receptacle 20.

The latch 80 can include a single tooth geometry that can mate with the teeth of the neck 56 when the latch 80 is moved to a closed position. The latch 80 can be unlocked by lifting the distal end thereof and rotating about ninety degrees. Once unlocked, the neck 56 (and in turn, the universal yoke 64) can move with respect to the lower receptacle 20 until the universal yoke 64 is placed over a top portion of the sunscreen canister 96 and in contact with the corresponding actuation head 90 (without triggering the actuation head 90). The latch 80 can then be used to lock the sunscreen canister so that is cradled in an operative position in the dispensing device 100 between the universal yoke 64 and the piston 36.

The neck 56 of the upper receptacle 50 can be arranged to travel about four inches with respect to the base 24 of the lower receptacle 20. This range of movement allows the dispensing device 100 of the present teachings to accommodate the shortest and tallest sunscreen canisters currently available on the market. However, different ranges of motion could be implemented depending on the environment of use as would be appreciated by one of ordinary skill in the art.

The latch 80 can further include one or more ears that can bite into the handle 28 to secure the latch 80 from movement when moved into the locked position. The secured position for the latch 80 can also serve as a physical indicator to a user that the latch 80 is locked.

The trigger 32 and piston 36 can operate as a remote actuation mechanism after a sunscreen canister has been loaded and cradled within the dispensing device 100. When the trigger 32 is depressed, the piston 36 is forced to move in a direction towards the universal yoke 64 thus causing the sunscreen canister to displace towards the universal yoke 64. The displacement of the sunscreen canister causes the nested actuation head 90 to interface with either of the two triggering surfaces 74, 78 of the universal yoke 64 resulting in sunscreen being dispensed unimpeded through the main window opening 66 of the universal yoke 64.

The neck 56 can include a relatively rigid structure to withstand the bending moment caused by the sunscreen canister being forced upwardly against the universal yoke 64. The neck 56 can include an I-beam geometry to provide a rigid structure. The neck 56 can be formed using a glass-filled nylon 6/6 material or any other material to allow it to withstand the forces created from the sunscreen canister interfaces with the universal yoke 64.

The shape of the universal yoke 64 and neck 56 of the upper receptacle 50, along with the generally open structure of the lower receptacle 20 results in a sunscreen canister being held on a top and bottom thereof when loaded into the dispensing device 100. This allows easy loading and unloading of the sunscreen canister into a front portion of the dispensing device 100. The open structure of the design precludes the use of an enclosed cylinder or walls that would add weight to the dispensing device 100 and would prevent a user from seeing the labeling of a loaded sunscreen canister.

Referring to FIGS. 3A, 3B, 4 and 5, the inner geometry of the universal yoke 64 can include one or more support ribs 68, 70, one or more actuating nubs 72, and one or more actuating tabs 76. The inner geometry allows the universal yoke 64 to nest with the top portions (including the actuation heads 90) of the most commonly used sunscreen canisters.

Figure 3A:
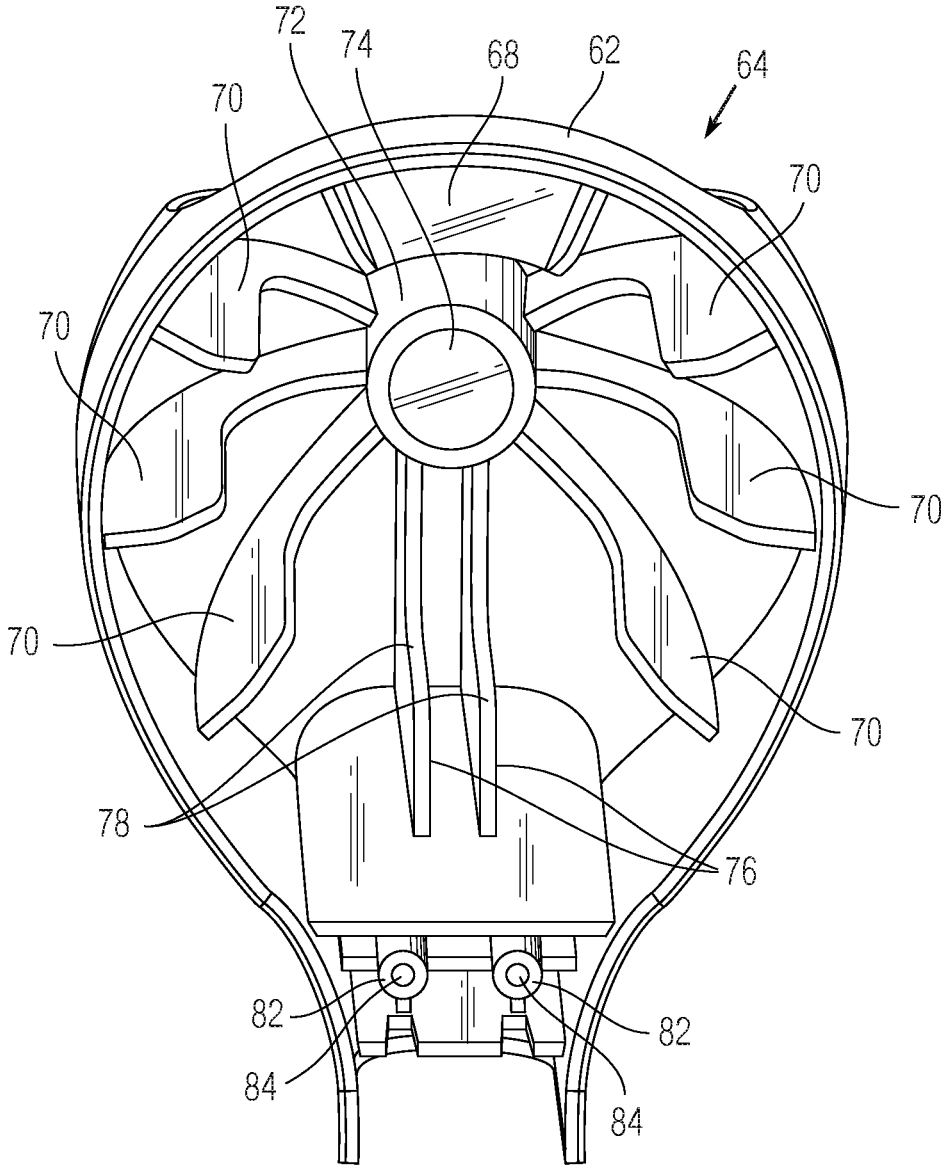
FIG. 3A shows a perspective view looking upwardly at the inner geometry of the universal yoke of the present teachings.

The support ribs can include horizontal support ribs 68 and vertical support ribs 70. The horizontal support ribs 68 and the vertical support ribs 70 can be arranged and shaped to nest with the top portions of the sunscreen canisters including their corresponding actuation heads 90 in a manner that substantially aligns a longitudinal axis of the sunscreen canister with a central axis of the dispensing device 100. At least one horizontal support rib 68 can be arranged to mimic the radius of the vertical support ribs 70 at a horizontal plane of engagement. The geometry of the horizontal and vertical support ribs 68, 70 allows the actuation heads to fit, with room to travel along the longitudinal axis of the dispensing device 100, while maintaining a snug fit. One or more horizontal support ribs 68 can form a portion of the main window opening 66 for the atomized sunscreen to spray through. Each of the horizontal support ribs 68 and vertical support ribs 70 can provide increased structural integrity for the universal yoke 64. As shown in FIG. 3A, a preferred embodiment of the universal yoke 64 of the present teachings can include one horizontal support rib 68 and six vertical support ribs 70.

As previously set forth above, actuation heads for sunscreen canisters generally fall into 5 different designs, each possessing a different trigger point for product to be dispensed. As a result, in order to actuate each of these trigger points, the universal yoke 64 of the present teachings has been designed to include two different triggering surfaces 74, 78. The first triggering surface 74 can be formed on an actuating nub 72 and a second triggering surface 78 can be formed on an actuating tab 76. During use, either the first triggering surface 74 or the second triggering surface 78 operates to independently actuate a trigger point of an actuation head 90 when the trigger 32 is depressed. The design of the universal yoke 64 is such that the non-actuating triggering surface (as well as the support ribs 68, 70) do not interfere with the actuation head , notwithstanding the type of sunscreen canister 96 and actuation head 90 is loaded into the dispensing device 100.

Figure 3B:
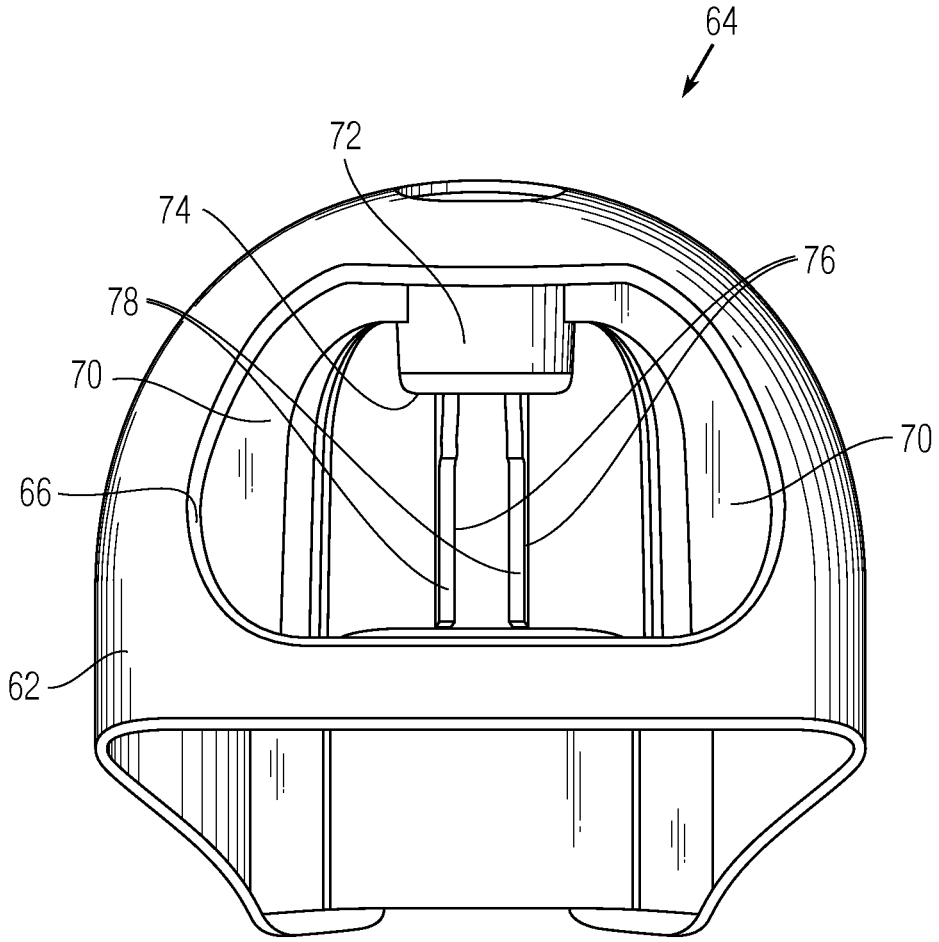
FIG. 3B shows a front view of the universal yoke of FIG. 3A.
Figure 4:
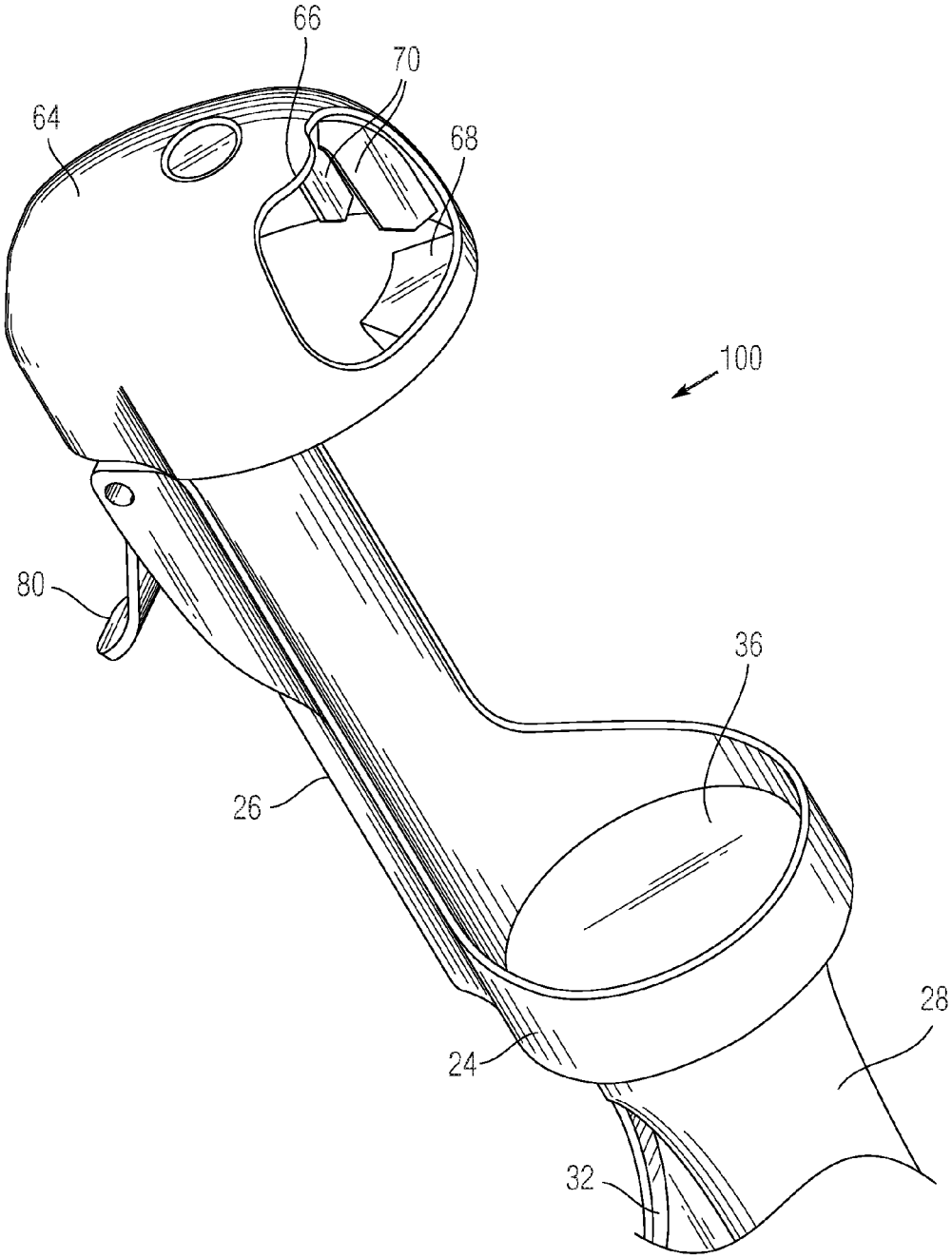
FIG. 4 shows another perspective view of the dispensing device of the present teachings showing a portion of the inner geometry of the universal yoke.
Figure 5:
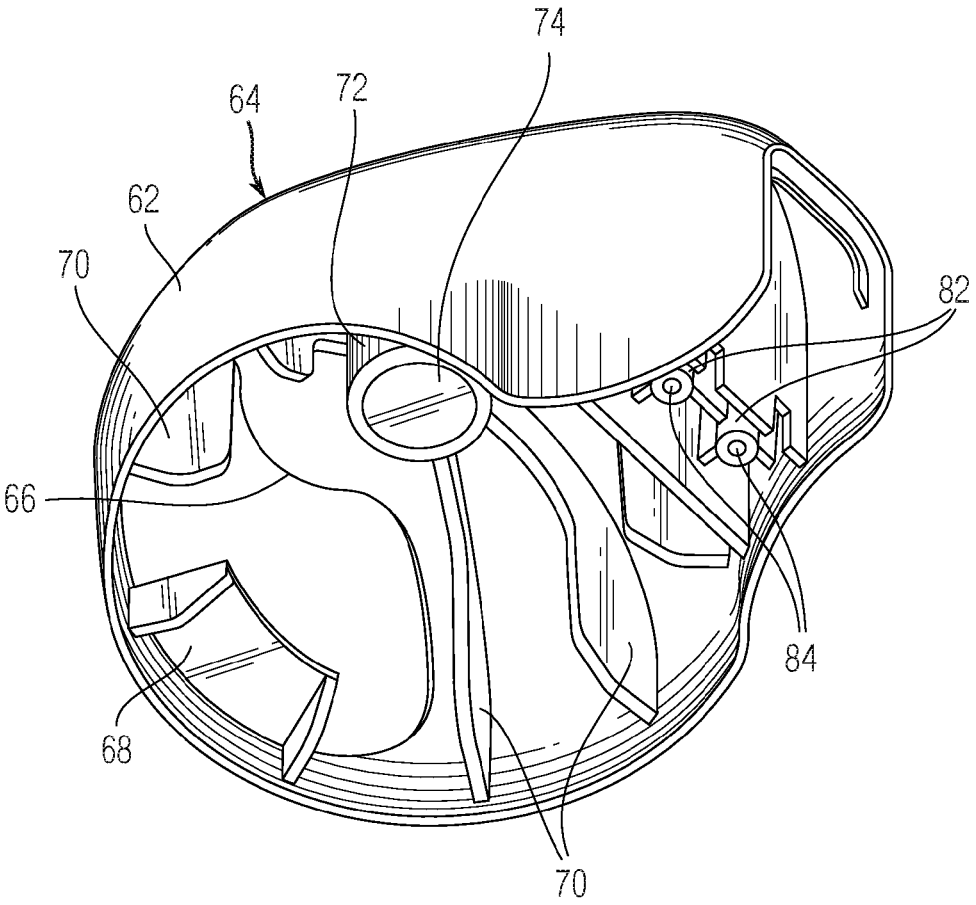
FIG. 5 shows a perspective view looking upwardly at the inner geometry of the universal yoke of the present teachings.

As best shown in FIGS. 3A, 3B, and 5, the actuating nub 72 can be formed at the inner, top portion of the universal yoke 64. The actuating nub 72 can include a truncated cone or cone-like shape that can extend downwardly from the interior of the universal yoke 64. The first triggering surface 74 can be formed on the truncated surface of the actuating nub 72. The first triggering surface 74 is shaped and arranged for actuation heads 90 that actuate by depressing in the forward direction, see FIGS. 6A and 6D which show these types of actuation heads 90.

The actuating tab 76 can be formed by one or more vertical ribs that extend from a back portion of the universal yoke 64. As best shown in each of FIGS. 6A-6E, the actuating tab 76 can include a stepped profile that forms the second triggering surface 78. The second triggering surface 78 can begin at a back side of the actuating nub 72 and extend in a rearward direction. The stepped profile of the second triggering surface 78 is shaped and arranged for actuation heads 90 that actuate by depressing in the rearward/downward direction, see FIGS. 6B, 6C, and 6E which show these types of actuation heads 90.

In use, a dispensing device 100 is loaded with a sunscreen canister and actuation of the trigger 32 forces the actuation head 90 against the universal yoke 64 whereby either the actuating nub 72 or the actuating tab 76 engages a trigger point of the actuation head 90. In other words, either the first triggering surface 74 or the second triggering surface 78 operates to contact and depress the actuation head 90 to result in sunscreen being dispensed unimpeded through the main window opening 66 of the universal yoke 64.

FIGS. 6A-E show the respective trigger points A, B, C, D, and E for the five most common designs of actuation heads 90 when used with the universal yoke 94 of the present teachings. In the upper portion of each figure, a trigger point is shown for the particular actuation head 90 shown below it and new trigger points are added sequentially in the upper portions of the figures as one moves rightward to show the relative positions of the trigger points. In these figures, the horizontal and vertical support ribs 68, 70 have been omitted so as to more clearly show the shape and operation of the actuating nub 72 and actuating tab 76 with respect to the five different commonly used actuation heads 90.

Figures 6A, 6B, 6C, 6D, 6E:
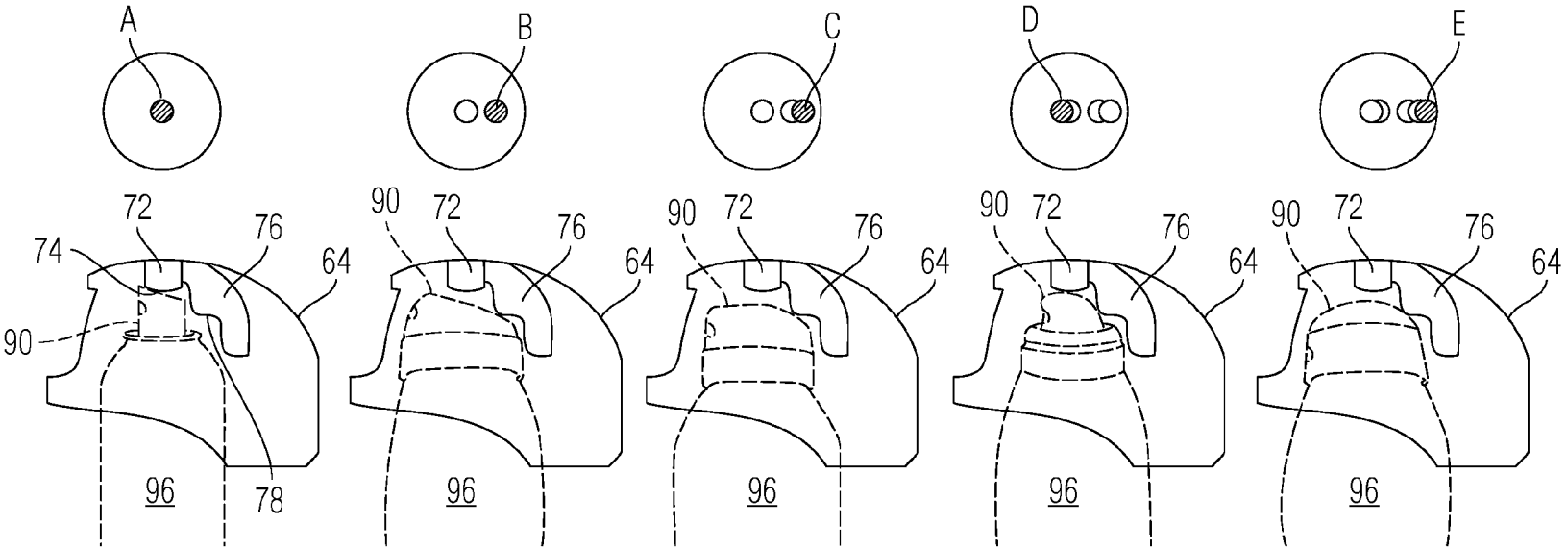
FIG. 6A-E show respective trigger points for five of the most common designs of actuation heads used with the universal yoke of the present teachings.

In particular, FIGS. 6A and 6D show trigger points A, D that actuate by the first triggering surface 74 formed by the actuating nub 72. These trigger points represent actuation heads 90 that actuate by depressing in the forward direction.

FIGS. 6B, 6C, and 6E show trigger points B, C, D that actuate by the second triggering surface 78 formed by the actuating tab 76. These trigger points represent actuation heads 90 that actuate by depressing in the rearward or downward direction.

The upper portions of FIGS. 6A-E visually show how for all of the most commonly used sunscreen canisters, either the first triggering surface 74 or the second triggering surface 78 of the universal yoke 64 operates to individually depress an actuation head 90, whereby the non-actuating triggering surface does not interfere (i.e. contact) the actuation head 90.

Referring to FIG. 5, the inner geometry of the universal yoke 64 can further include one or more screw bosses 82 which can provide structural strength and rigidity, and serves to locate one or more screw apertures 84. The one or more screw bosses 82 can provide a mechanism to connect the universal yoke 64 to the neck 56 by way of one or more screws 86.

According to a preferred embodiment, the universal yoke 64 can be manufactured from ABS plastic. Moreover, the universal yoke 64 can be made using a single-parted, two-piece injection molding process without the use of any secondary parting lines, slides, or cores for economic considerations, aesthetics and structural integrity. However, the universal yoke 64 could be made from any other material capable of withstanding the forces created from the sunscreen canister interfaces with the universal yoke 64. Other materials could be used for the universal yoke 64, as well as for the other components of the dispensing device 100, as would be appreciated by a one of ordinary skill in the art.

Those skilled in the art can appreciate from the foregoing description that the present teachings can be implemented in a variety of forms. Therefore, while these teachings have been described in connection with particular embodiments and examples thereof, the true scope of the present teachings should not be so limited. Various changes and modifications may be made without departing from the scope of the teachings herein.

What is claimed is:

1. A universal yoke for actuating an actuation head of a canister comprising:

a plurality of support ribs;

an actuating nub including a first triggering surface; and an actuating tab including a second triggering surface;

wherein the plurality of support ribs are arranged to nest with a plurality of differently shaped top portions of canisters; and wherein either one of the first triggering surface and the second triggering surface are arranged to independently actuate the actuation head of a nested canister top portion when the canister is forced into contact with the universal yoke.

2. The universal yoke of claim 1, wherein a non-actuating triggering surface does not contact the actuation head when the canister is forced into contact with the universal yoke.

3. The universal yoke of claim 1, wherein the actuating nub includes a truncated cone shape and the first triggering surface is formed on a truncated surface of the actuating nub.

4. The universal yoke of claim 1, wherein the second triggering surface of the actuating tab includes a stepped profile.

5. The universal yoke of claim 1, wherein the universal yoke defines a main window opening arranged to allow product to be dispensed therethrough from the actuation head.

6. The universal yoke of claim 1, wherein the universal yoke is arranged on a dispensing device capable of cradling various sized canisters.

7. A universal dispensing device comprising:

a lower receptacle including a movable piston; and an upper receptacle including a universal yoke;

wherein the universal yoke includes an actuating nub including a first triggering surface and an actuating tab including a second triggering surface;

wherein either one of the first triggering surface and the second triggering surface are arranged to independently actuate an actuation head of a canister cradled between the universal yoke and the piston when the actuation head is forced into contact with the universal yoke.

8. The universal dispensing device of claim 7, wherein the first triggering surface and the second triggering surface are arranged to independently actuate a plurality of differently shaped actuation heads.

9. The universal dispensing device of claim 7, wherein a non-actuating triggering surface does not contact the actuation head when the actuation head is forced into contact with the universal yoke.

10. The universal dispensing device of claim 7, wherein the actuating nub includes a truncated cone shape and the first triggering surface is formed on a truncated surface of the actuating nub.

11. The universal dispensing device of claim 7, wherein the second triggering surface of the actuating tab includes a stepped profile.

12. The universal dispensing device claim 7, wherein the universal yoke defines a main window opening arranged to allow product to be dispensed therethrough from the actuation head.

13. The universal dispensing device claim 7, wherein the upper receptacle is capable of being adjusted with respect to the lower receptacle.

14. A universal dispensing device comprising:

a housing receptacle configured to support a canister having an actuation head;

a movable member arranged on one end of the housing receptacle; and a universal yoke arranged on the other end of the housing receptacle;

wherein the universal yoke includes an actuating nub including a first triggering surface and an actuating tab including a second triggering surface, the first triggering surface and the second triggering surface being arranged to independently actuate a plurality of differently shaped actuation heads of canisters.

15. The universal dispensing device of claim 14, wherein a non-actuating triggering surface does not contact the actuation head when the actuating triggering surface independently actuates the actuation head.

16. The universal dispensing device of claim 14, wherein the actuating nub includes a truncated cone shape and the first triggering surface is formed on a truncated surface of the actuating nub.

17. The universal dispensing device of claim 14, wherein the second triggering surface of the actuating tab includes a stepped profile.

18. The universal dispensing device claim 14, wherein the universal yoke defines a main window opening arranged to allow product to be dispensed therethrough from the actuation head.

19. The universal dispensing device claim 14, wherein the housing receptacle includes an upper receptacle and a lower receptacle, the upper receptacle being capable of being adjusted with respect to the lower receptacle.

20. The universal dispensing device claim 14, wherein the universal yoke includes a plurality of support ribs.

* * * * *